US006012516A

United States Patent [19]

Brunet

[11] Patent Number: 6,012,516

[45] Date of Patent: Jan. 11, 2000

[54] DEVIATED BOREHOLE DRILLING ASSEMBLY

[75] Inventor: Charles G. Brunet, Houston, Tex.

[73] Assignee: Schlumberger Technology Corporation, Sugar Land, Tex.

[21] Appl. No.: 08/923,945

[22] Filed: Sep. 5, 1997

[51] Int. Cl.[7] ..... E21B 7/08

[52] U.S. Cl. ..... 166/50; 166/117.6; 175/80; 175/81

[58] Field of Search ..... 166/50, 117.6; 175/80, 81, 82

[56] References Cited

U.S. PATENT DOCUMENTS

| | | | |
|---|---|---|---|
| 2,338,788 | 1/1944 | Walker | 166/117.6 |
| 3,710,864 | 1/1973 | Mitchell . | |
| 4,763,519 | 8/1988 | Comeau . | |
| 4,872,708 | 10/1989 | Abreo . | |
| 5,115,872 | 5/1992 | Brunet . | |
| 5,154,231 | 10/1992 | Bailey et al. | 166/117.6 |
| 5,163,521 | 11/1992 | Pustanyk . | |
| 5,293,945 | 3/1994 | Rosenhauch . | |
| 5,311,936 | 5/1994 | McNair . | |
| 5,318,121 | 6/1994 | Brockman . | |
| 5,335,737 | 8/1994 | Baugh | 166/117.6 X |
| 5,341,873 | 8/1994 | Carter et al. | 166/117.5 |
| 5,410,303 | 4/1995 | Comeau . | |
| 5,425,419 | 6/1995 | Sieber | 166/117.6 X |
| 5,435,392 | 7/1995 | Kennedy . | |
| 5,458,209 | 10/1995 | Hayes . | |
| 5,472,048 | 12/1995 | Kennedy . | |
| 5,484,017 | 1/1996 | Coon . | |
| 5,579,829 | 12/1996 | Comeau . | |
| 5,602,541 | 2/1997 | Comeau . | |
| 5,615,740 | 4/1997 | Comeau . | |
| 5,806,600 | 9/1998 | Halford, Sr. | 175/81 X |
| 5,829,531 | 11/1998 | Hebert et al. | 166/117.6 |

FOREIGN PATENT DOCUMENTS

| | | |
|---|---|---|
| 2302702 | 1/1997 | United Kingdom . |
| WO9533910 | 12/1995 | WIPO . |

*Primary Examiner*—George Suchfield
*Attorney, Agent, or Firm*—Bennett Jones

[57] ABSTRACT

An assembly for formation and completion of deviated wellbores is disclosed which includes a toolguide and a casing section which can be used together or separately. The toolguide includes a lower orienting section and an upper section having a sloping face, commonly known as the directional portion of a whipstock. The toolguide is coated with a material such as epoxy or polyurethane to provide a repairable surface and one which can be removed to facilitate removal of the toolguide from the well bore. The lower orienting section has a latch which extends radially outwardly from the section and can be locked in the outwardly biased position. The casing section of the present invention includes a sleeve which can be moved between a first position in which access to the window opening of casing section is not affected and a second position in which the main casing is sealed from the liner section of a deviated wellbore to provide a hydraulic seal against passage of fluids from outside the casing of the wellbore into the main casing.

12 Claims, 8 Drawing Sheets

FIG. 3a
FIG. 3b
FIG. 3
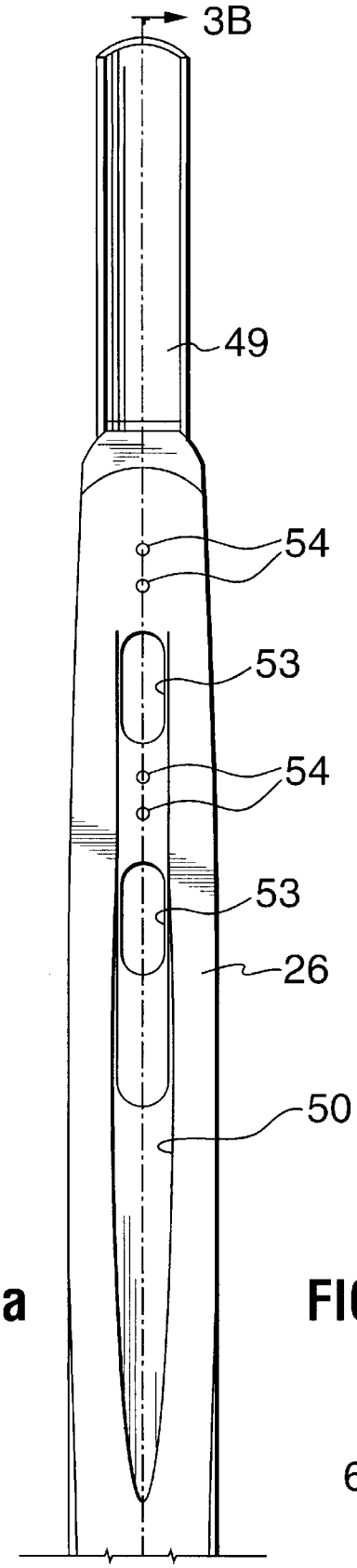
FIG. 3a
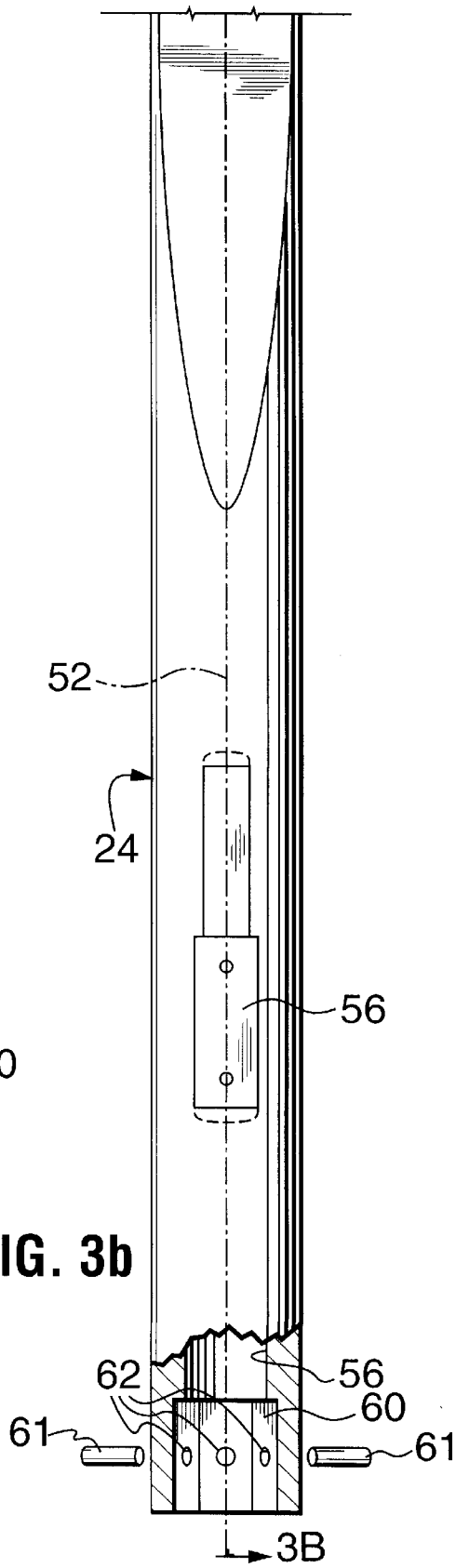
FIG. 3b

DEVIATED BOREHOLE DRILLING ASSEMBLY

FIELD OF THE INVENTION

The present invention is directed to a borehole drilling assembly and in particular to an assembly for drilling and completing deviated boreholes.

BACKGROUND OF THE INVENTION

Deviated boreholes are drilled using whipstock assemblies. A whipstock is a device which can be secured in the casing of a well and which has a tapered, sloping upper surface that acts to guide well bore tools along the tapered surface and in a selected direction away from the straight course of the well bore.

To facilitate the use of a whipstock, a section of casing is used which has premilled window openings through which deviated well bores can be drilled. The whipstock can be positioned relative to the window using a landing system which comprises a plurality of stacked spacers mounted on a fixed mounting device at the bottom of the casing and defining at the top thereof a whipstock retaining receptacle, or by use of a latch between the whipstock and the casing. The use of a stacked landing system can cause difficulty in aligning the whipstock with the window opening as the distance between the mounting device and the window increases. The whipstock may also turn during the drilling or setting processes resulting in the deviated well bore being directed incorrectly and/or the well bore tools being stuck in the wellbore. The use of a latch some of these disadvantages are overcome, but the latch can sometimes disengage between the whipstock and the casing also allowing the whipstock to turn or move down the casing.

After the deviated wellbore is drilled, it can be left uncompleted or completed in any suitable way. To seal the deviated wellbore hydraulically from the main casing, a liner can be installed and cement can be pumped behind the liner. This is expensive and often creates obstructions in the main casing which complicates removal and run of the tools.

SUMMARY OF THE INVENTION

An assembly for drilling and/or completing a deviated wellbore has been invented. In one aspect the assembly includes a toolguide which can be positioned relative to a window opening in a casing section and releasably locked in position. The toolguide or portions thereof can have applied thereto a coating which prevents damage to the metal components of the toolguide and facilitates removal of the toolguide from the wellbore after use.

In accordance with a broad aspect of the present invention, there is provided a tool guide for creating deviated borehole branches from a wellbore comprising an upper section including a sloping face portion and a lower orienting section, including at least one latch biased radially outwardly from the orienting section and positioned in a known orientation relative to the sloping face portion and a latch locking means to releasably lock the latch in an extended position, the latch locking means being actuated to lock the latch by torsion of the upper section relative to the lower orienting section.

Each latch of the orienting section is selected to fit within and lock into its own latch receiving slot formed in the casing. When the latch of the orienting section is locked into the latch receiving slot the toolguide will be maintained in position in the casing. Preferably, the casing includes at least one premilled window opening positioned in known relation relative to the latch receiving slot. Preferably, a removable liner can be positioned in the casing to close the window opening temporarily and to cover the latch receiving slot.

The orienting section can be releasably connected to the upper section. Such connection is preferably by connectors such as, for example, shear pins to the upper section so that these parts can be installed together into the casing. Preferably, the connectors are selected such that the sections can be separated by an application of force sufficient to overcome the strength of the connectors. This permits the upper section and the lower section to be separated and removed separately should one part become stuck in the casing.

The sections are movable relative to one another and means are provided to translate such movement to actuate such means as a seal.

Preferably, the lower orienting section includes a mandrel engaged slidably and rotatably within an outer housing. The mandrel is releasably connected to the upper section and moveable with the upper section. Preferably, the latch locking means is an extension of the mandrel. The extension can be formed to fit behind the latch to lock it in the outwardly biased position.

According to a further aspect of the present invention, there is provided a toolguide for creating borehole branches from a wellbore, the toolguide having a longitudinal axis and comprising an upper section including a sloping face portion, a lower orienting section, the upper section and the lower orienting section being connected and moveable relative to each other along the longitudinal axis of the toolguide, and an annular sealing means mounted below the upper section, the annular sealing means being actuatable to expand and retract upon movement of the upper section and the lower orienting section relative to one another.

In one embodiment, the upper section is attached to a central mandrel of the lower orienting section. The central mandrel is engaged slidably and rotatably within an outer housing of the lower orienting section. The outer housing carries the annular sealing means which is actuatable to expand or retract by movement of the mandrel within the outer housing. Preferably, the outer housing includes a first section and a second section and disposed therebetween the annular sealing means. The first section is moveable toward the second section to compress the annular sealing means therebetween and cause it to expand outwardly. In this embodiment, preferably the mandrel has a shoulder positioned thereon to abut against the first section and limit the movement of the mandrel into the outer housing. Abutment of the shoulder against the first section causes the first section of the housing to be driven it towards the second section and the annular sealing means to be compressed and expanded outwardly.

According to another broad aspect of the present invention, there is provided an upper section for a toolguide for use in creating wellbore branches from a well bore, the upper section being formed of a first material and having a surface and comprising a coating material disposed at least over a portion of its surface, the coating material being softer than the first material and being resistant to oil and gas.

Preferably, the coating material comprises polymers such as epoxy and/or polyurethane. The polymer is preferably coated onto the tool by use of a mold, so that the shape of the tool after coating is controllable. If damage occurs to the coating, it can be replaced.

In accordance with yet another broad aspect of the present invention, there is provided a casing section for a deviated wellbore junction comprising a cylindrical casing tube having a central axis and a window opening formed therein and a sleeve having an opening therein, the sleeve being mounted relative to the casing tube to move between a first position in which the opening of the sleeve is aligned with the window opening of the casing tube and a second position in which the opening of the sleeve is not aligned with the window opening of the casing tube.

According to another broad aspect, there is provided a casing section for a deviated wellbore junction comprising a casing tube having a central axis and a window opening formed therein and a sleeve having a first opening and a second opening therein, the sleeve being mounted relative to the casing tube to move between a first position in which the first opening of the sleeve is aligned with the window opening of the casing tube and a second position in which the second opening of the sleeve is aligned with the window opening of the casing tube.

Preferably, sealing means are disposed between the casing tube and the sleeve. These sealing means are preferably selected to effect a hydraulic seal between the parts. In one embodiment, the sealing means is formed of deformable material such as rubber or plastic and is disposed around the opening of the sleeve and along the top and bottom thereof.

In one embodiment, the sleeve is disposed within the casing tube in a counterbore formed therein such that the inner diameter of the sleeve is greater than or substantially equal to the inner diameter of the casing away from the position of the sleeve.

Preferably, the window of the casing is formed to accept a flange of a junction fitting such as, for example, a tie back hanger of a branched wellbore. In a preferred embodiment, the sleeve is selected to seal against the flange of the fitting.

In a preferred embodiment, the sleeve has formed therethrough two openings. The first opening is sized to allow access to the window opening of the casing section by deviated borehole tools and the second opening is smaller than the first opening.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIG. 3 is a view showing the orientation of FIGS. 3*a* and 3*b;*

FIGS. 3*a* and 3*b* are front elevation views, partly cutaway, of an upper section of a toolguide according to the present invention;

FIG. 5A is a front elevational view of a lower section of a toolguide according to the present invention, partly in section and in un-compressed configuration;

FIG. 5B is a front elevational view of the toolguide of FIG. 5A in compressed configuration;

DETAILED DESCRIPTION OF THE PREFERRED EMBODIMENTS

Figure 1:
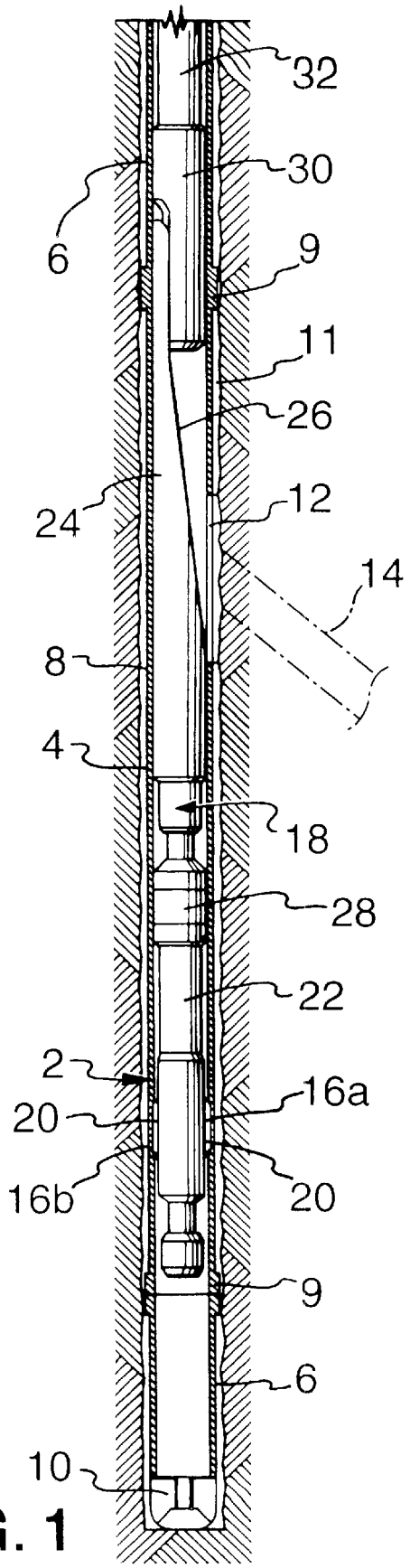
FIG. 1 is a schematic representation of an embodiment of an assembly according to the present invention in a wellbore.

For the purposes of clarity, in the Figures only reference numerals of the main components are indicated and like reference numerals relate to like components.

Referring to FIG. 1, there is a shown a tubular wellbore casing 2 for installation in a wellbore 4 drilled through a formation. Casing 2 includes upper and lower sections of production casing 6 and secured therebetween a casing section 8 for use in deviated wellbore junctions. The deviated wellbores branch from wellbore 4.

Casing sections 6 and 8 are connected by standard connectors 9 or any other suitable means. A float collar 10 is provided at the lower end of casing 2 which allows fluids to flow out of the casing but prevents flow of fluid and debris back into wellbore casing 2. Any similar one way valve can be used in the place of float collar 10. Cement 11 is disposed in the casing annulus.

Casing section 8 includes a window in the form of an elongated opening 12 extending in the longitudinal direction of casing 8. In use, opening 12 is oriented toward the desired direction of a deviated wellbore to be drilled, shown in phantom at 14. The window is sized and shaped with reference to the desired diameter and azimuth of the deviated wellbore to be drilled and the diameter of the casing, as is known in the art.

Casing section 8 further has formed therein a latch receiving slot 16*a* at a selected orientation relative to window opening 12. The latch receiving slot could be oriented at any point around the interior circumference of the casing section, so long as its position is known with respect to the window opening. Preferably, latch receiving slot 16*a* is aligned with the longitudinal axis of window 12, as shown, or is directly opposite window opening 12.

A toolguide 18 is installed in casing 2 with its latch 20 extending into slot 16*a*. Toolguide 18 includes a lower orienting section 22, from which latch 20 is biased radially outwardly, and an upper section 24 having a sloping face portion 26. Sections 22 and 24 are connected so that they are not free to rotate relative to each other, whereby face portion 26 is maintained in a fixed and known orientation relative to latch 20. In a preferred embodiment, as shown, latch 20 is aligned at the bottom of sloping face portion 26, so that the surface of the sloping face portion will be aligned opposite window opening 12, when latch 20 is in slot 16*a*.

An annular expandable seal 28 is disposed on toolguide 18 below sloping face portion 26. The seal 28 when expanded, acts to prevent debris and fluids from passing down the wellbore. Seal 28 is therefore selected to have an outer diameter, when expanded, which is greater than the inner diameter of the casing 2 in which it is to be used.

Toolguide 18 is placed in casing 2 by use of a running tool 30 which releasably locks into upper section 24 and is shown in this drawing still attached to the upper section. Running tool 30 is connected to a drill pipe 32.

Figure 2:
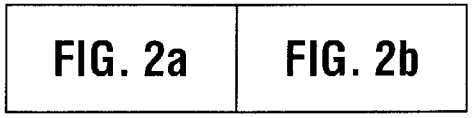
FIG. 2 is a view showing the orientation of FIGS. 2*a* and 2*b:*
Figure 2A:
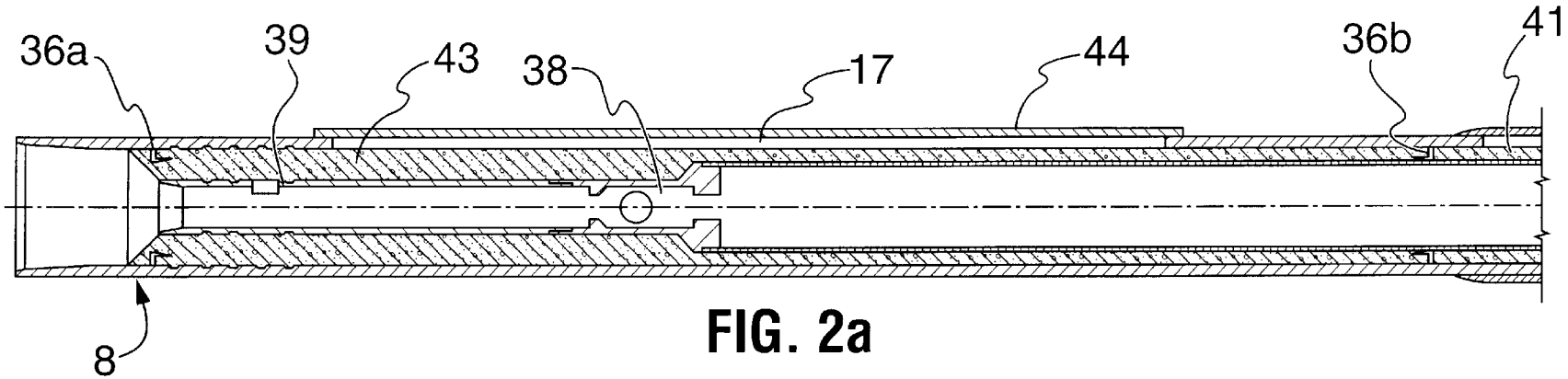
FIGS. 2*a* and 2*b* are longitudinal sections along a casing section for a deviated wellbore junction useful in the present invention.
Figure 2B:
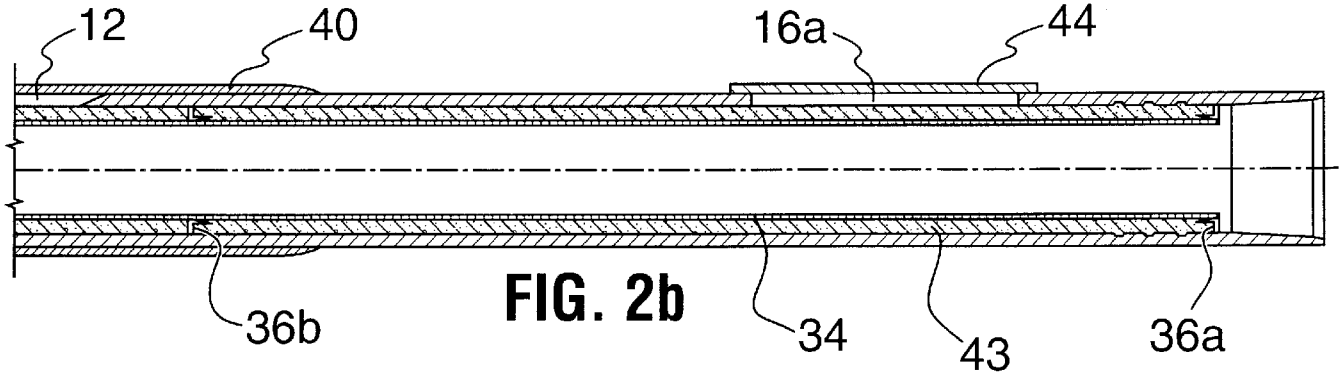

To prepare for the drilling of a deviated borehole, such as that shown at 14, the wellbore casing 2 is installed and completed. FIG. 2 shows apparatus useful for permitting completion of the well while preserving features used in the invention. Casing section 8 is milled to include a window opening 12 and a latch receiving slot 16*a*. Preferably, a slot 17 (FIG. 2) for alignment of retrieval tools is also milled out in casing section 8. Preferably, window opening 12 and latch receiving slot 16*a* are aligned along the casing.

An aluminum liner 34 is positioned in casing 8 and seals 36*a* and 36*b* are provided between liner 34 and casing 8. A float collar 38 and an orienting subassembly 39 are attached above liner 34. Preferably, a removable filler 41, such as foam, is inserted between casing 8 and liner 34 between seals 36*b* to fill window opening 12 and the casing section 8 is wrapped in a rigid material 40, such as fibre glass or composite tape, to cover at least opening 12.

Preferably, any aluminum surfaces exposed to contact by cement, which will be used in the completion operation, are coated with a suitable material, such as rubber cement, to prevent degradation of the aluminum by contact with cement. Preferably, also slots 16*a* and 17 are filled with filling materials such as grease and/or foam to prevent materials from entering into the slots and the remainder of spaces 43, defined between casing 8, liner 34 and seals 36*a*, 36*b*, are filled with cement. To further prevent entry of materials into slots 16*a*, 17, caps 44 are welded onto the outer surface of casing 8 over the slots.

Casing 8, including the parts as noted hereinbefore, is connected to casing sections 6 to form casing string 2 and float collar 10 is attached. Casing string 2 is lowered into wellbore 4. The casing string is rotated until window opening 12 is oriented in the direction in which it is desired that the deviated wellbore 14 should extend. Suitable methods are well known in the oil industry for orienting downhole tools, for example, using a surface reading gyro.

The cased wellbore is completed by forcing cement through the casing string and into the annulus between the casing and the wellbore. During completion, the cement is forced through float collar 38 and liner 34 but is prevented from entry behind liner 34 by seals 36*a* and the cement and fillers in spaces 43. (It is to be understood that only one float collar is needed and float collar 10 need not be used when float collar 38 is used.) As the cement fills the casing annulus, it is prevented from entering slot 16*a* by cap 44 and is prevented from entering window opening 12 by the filler 41 and rigid materials 40. The cement is allowed time to set.

After completion, a drill (not shown) of a diameter selected to be approximately equal to the inner diameter of the casing is run into the well to remove cement from the casing bore. The drill will also drill out liner 34, seals 36*a*, 36*b*, float collar 38 and cement in spaces 43. The casing is then ready for production or for drilling deviated wellbores. Where deviated wellbores are to be drilled a toolguide 18 will be run in and oriented in the casing as shown in FIG. 1.

Figure 4:
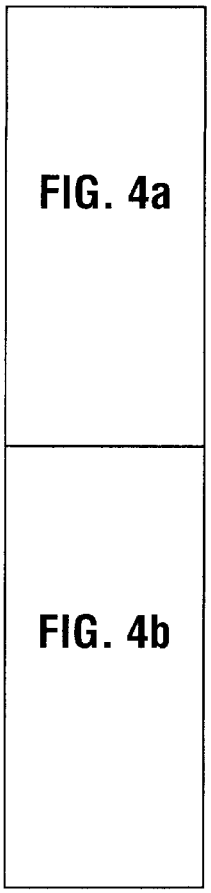
FIG. 4 is a view showing the orientation of FIGS. 4*a* and 4*b;*
Figure 4A:
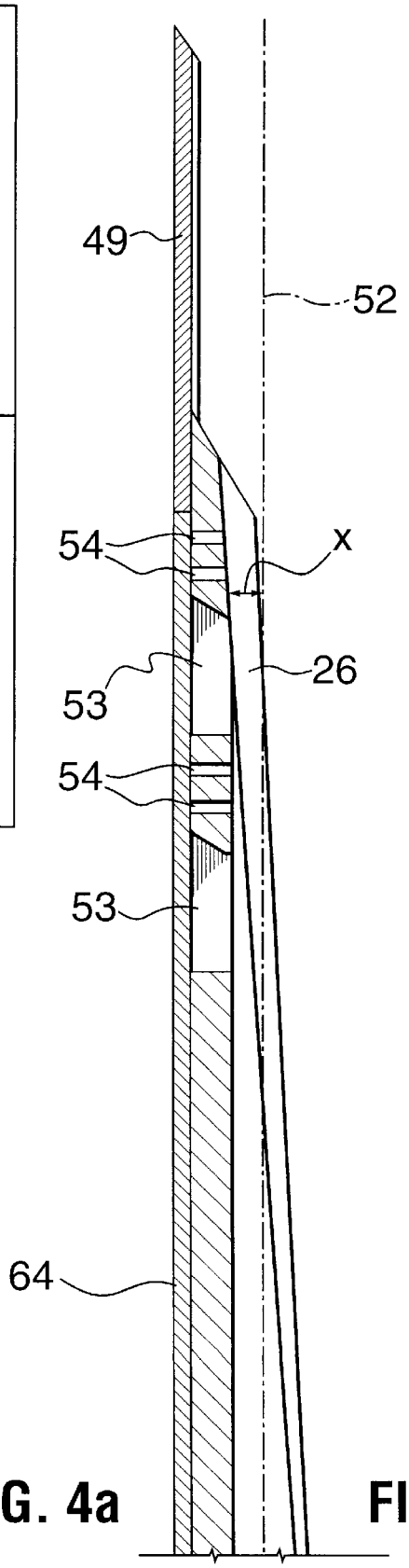
FIGS. 4*a* and 4*b* are sections along line 3—3 of FIGS. 3.
Figure 4B:
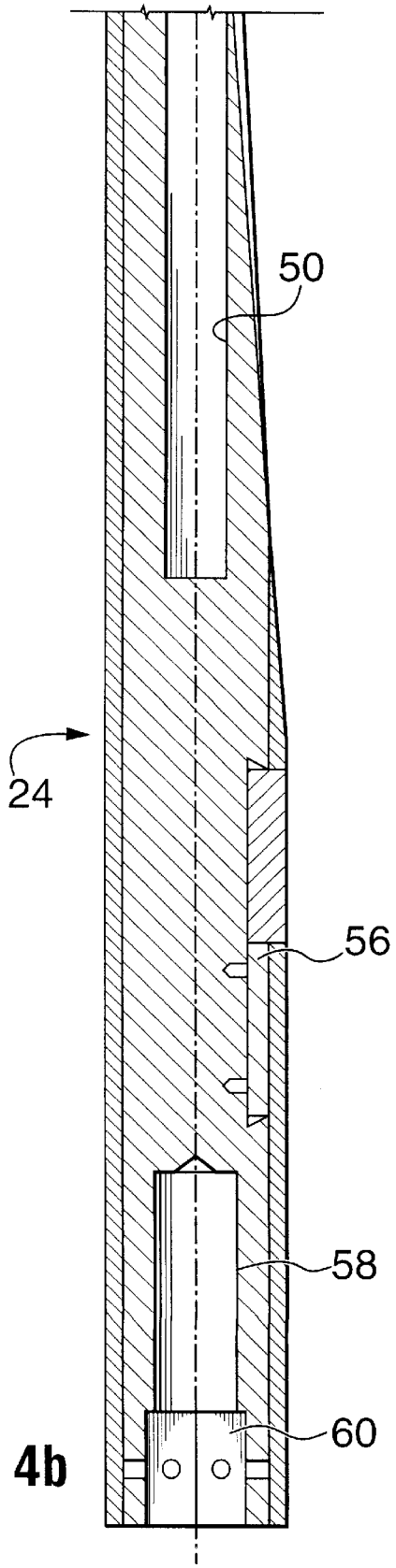

Referring to FIGS. 3 and 4, an embodiment of an upper section 24 of a toolguide according to the present invention is shown. The upper section tapers toward its upper end to form a sloping face portion 26 which is formed to direct any tool pushed along it out to the side at a selected angle. The face portion is machined to have a selected slope x or range of slopes with respect to axis 52 depending on the build radius desired for the deviated wellbore. As an example, when x is 4°, the build radius will be approximately 15°/30 meters drilled. Preferably, sloping face portion 26 is formed to be concave along its width.

An entry guide 49 is welded at the top of face portion 26. Entry guide 49 assists in centralization and tool retrieval and need only be used, as desired. A bore 50 extends a selected distance through the upper section parallel to its central axis 52. Bore 50 is formed to engage a fishing spear device and provides one means of retrieving the toolguide from the wellbore. Extending back from face portion are slots 53 formed to accept and retain a retrieval tool having corresponding sized and spaced hooks thereon. Also formed on face portion 26 are apertures 54 formed to accept shear pins (not shown) for attachment to running tool 30 (FIG. 1).

Centralizers 56 are spaced about the upper section. While only one centralizer is illustrated in the drawing, there are preferably at least three centralizers on the upper portion to center the upper section in the hole.

A socket 58 extends from the bottom of upper section 24 parallel with central axis 52. Socket 58 is shaped to accept a male portion 68 on the lower orienting section 22, as will be discussed hereinafter with reference to FIGS. 5A and 5B. Preferably, socket 58 is faceted at 60 and male portion is similarly faceted so that the parts lock together and male portion 68 cannot rotate within socket 58. Shear pins 61 are inserted through apertures 62 to secure male portion 68 in socket 58 and thereby, the upper section to the lower section.

The upper section is formed of hardened steel. The outer diameter of the upper section is selected to be smaller than the inner diameter of the casing in which it is to be used.

Upper section 24 has applied thereto a polymeric coating 64 (shown only in FIG. 4). Polymeric coating 64 is preferably formed of cured polyurethane. Coating 64 acts to prevent damage of the metal components of the upper section and can be reapplied if it is removed during use. Coating 64 further facilitates wash over operations, should they become necessary to remove the toolguide or upper section from the casing. The coating is thick enough so that it will accommodate normal damage from, for example, abrasion and will prevent damage to the metal surfaces of the upper section and is preferably also thick enough so that substantially only the coating will be removed by any washover operation. In a preferred embodiment, the coating is about ½ inch thick and is applied using a mold.

Referring to FIGS. 5A and 5B, an embodiment of a lower orienting section 22 is shown. Section 22 is shown uncompressed in FIG. 5A and compressed in FIG. 5B. Lower orienting section 22 includes a male portion 68 shaped to fit into socket 58 on upper section 24. Bores 70 (only one is shown) accept ends of shear pins 61.

Male portion 68 is connected to a central mandrel 72 mounted in a bore 73 in a housing 74. Mandrel 72 is both moveable through and is rotatable within bore 73 as limited by movement of pin 76 on housing 74 in jay slot 78 formed in mandrel 72. Mandrel 72 can be releasably locked in position in housing by locking collet 77 frictionally engaging into knurled area 77*a*.

Housing 74 includes a top portion 80 and a lower portion 82. Each portion has a flange 84 which together retain an annular packing seal 28. Top portion 80 is moveable towards lower portion 82 as shown in FIG. 5B to compress packing seal 28 and cause it to expand outwardly.

Figure 5C:
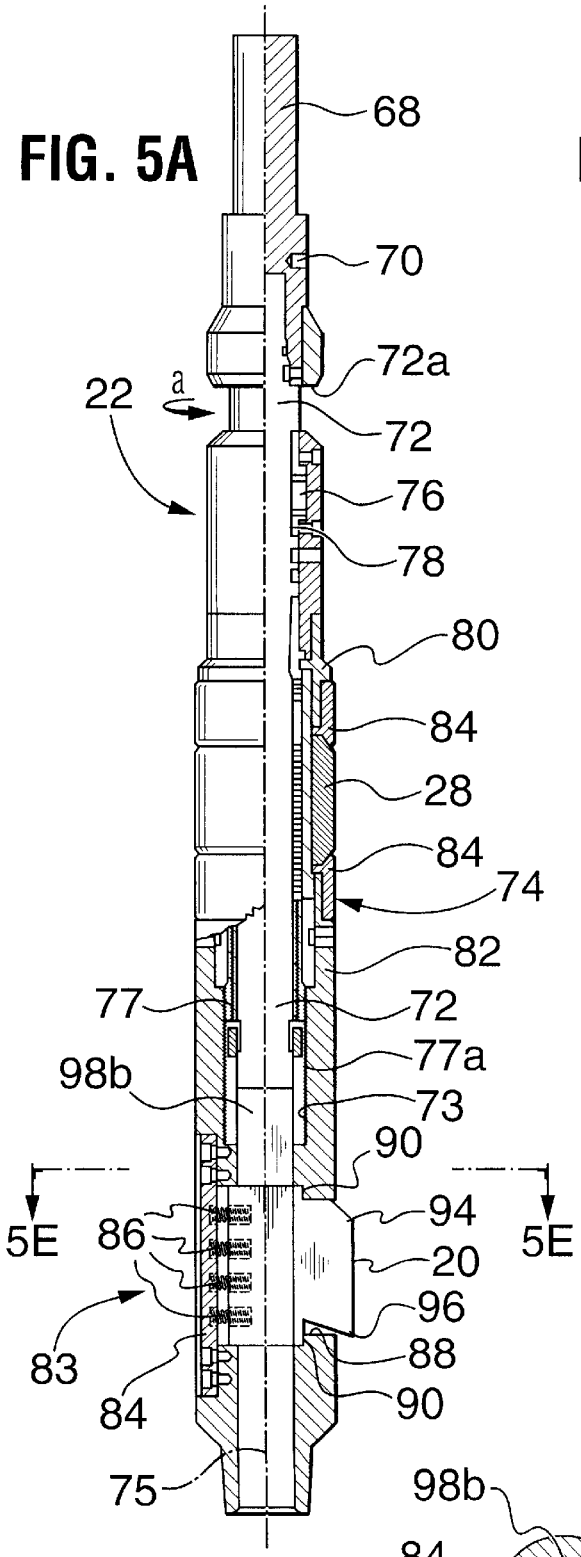
FIG. 5C is a section along line 5C—5C of FIG. 5A.
Figure 5C:
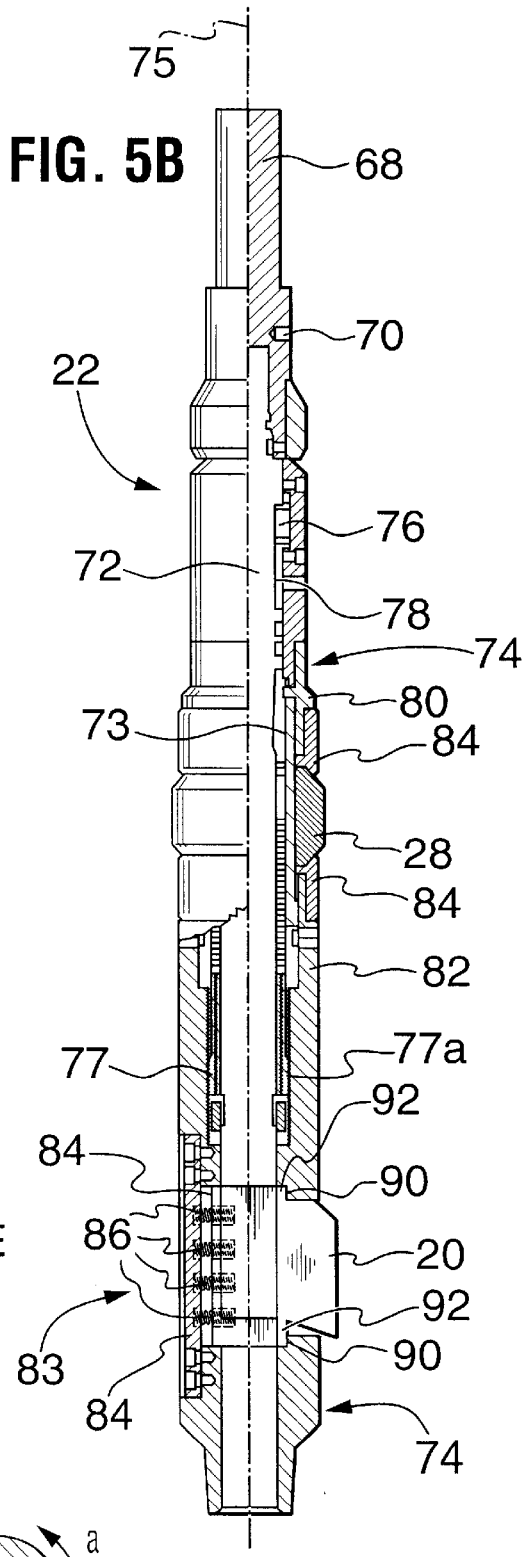
Figure 5C:
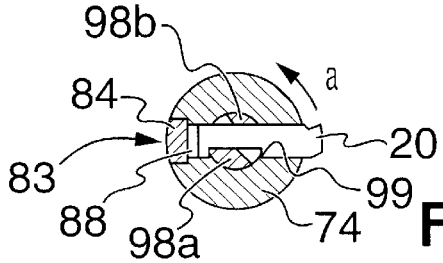

Referring to FIGS. 5A and 5C, housing 74 at its lower end accommodates latch assembly 83. Latch assembly 83 includes latch 20, a latch retaining plate 84 and springs 86.

Springs 86 act between latch 20 and latch retaining plate 84 to bias latch 20 radially outwardly from housing 74. Latch 20 is retained in a channel 88 through housing 74 which opens into bore 73. Latch 20 is prevented from being forced by the action of springs 86 out of the channel, by abutting flanges 90 which act against shoulders 92 on the latch. Latch 20 can be pushed into channel 88 by application of force on the latch toward plate 84.

Latch 20 is formed to fit into latch retaining slot 16*a* on casing 8 and has a ramped surface 94 on its upper edge, to ease removal from the slot, and a dove tail portion 96 on its lower edge to resist against the latch moving out of the slot by any downward force.

Mandrel 72 is bifurcated at is lower end to form two arms 98*a*, 98*b*. Arms 98*a*, 98*b* are formed to be extendable through bore 73 on either side of latch 20. Arms 98*a*, 98*b* are generally wedge-shaped to permit rotation of mandrel 72 in bore 73. As mandrel rotates, arms 98*a*, 98*b* are driven from a position in which they do not restrict movement of the latch in the channel to a position in which arm 98*a* abuts against shoulder 99 of latch 20 and prevents it from moving back into channel 88. In this way arm 98*a* can be moved to act as a lock against retraction of latch 20 into channel 88. Arm 98*b* serves to stabilize the end of the mandrel, but, can be omitted from the mandrel, as desired.

In use, the toolguide is constructed by attaching upper section 24 to lower section 22 by insertion of shear pins 61 through apertures 62 and 70. The toolguide is run into the well until the latch 20 is about 1 meter below the slot 16*a* in casing section 8. The toolguide is hoisted and rotated slowly, until latch 20 is located in slot 16*a*. When the latch is located in the slot, the torque load will suddenly increase. As the string torques up, jay pin 76 will release, allowing mandrel 72 to rotate in a direction indicated by arrow a. When the force on the toolguide is released, the mandrel will be free to move down in housing 74 (FIG. 5B). Mandrel 72 includes a shoulder 72*a* disposed thereon and portioned to abut against top portion 80 of the housing to limit the movement of the mandrel into the housing. During rotation of the mandrel, arms 98*a*, 98*b* will be rotated so that arm 98*a* abuts against shoulder 99 of latch 20 and locks latch in the outwardly biased position. Mandrel arms can take other forms provided they are formed to lock behind the latch in response to rotation of the mandrel and/or movement of the mandrel through the housing.

A downward movement of the string allows the toolguide to travel down until portion 96 of the latch lands against the bottom of slot 16*a*. Latch 20 and housing 74 will support the weight of the tool and upper portion of the housing will be driven down by the weigh of the upper section to compress seal 28 allowing it to set. The set force is locked in by collet 77. The upper section 24 is now aligned with window opening 12 and the directional drilling operations can begin.

After the directional drilling operations are completed, a retrieving tool is run in to retrieve the toolguide. Preferably, in the simplest retrieval procedure, a straight upward force, for example of about 20,000 psi on the toolguide will unlock locking collet 77 and permit mandrel 72 to be pulled up. This pulls arm 98*a* out of abutting engagement with the latch and releases seal 28. The toolguide can then be removed from the well.

If the toolguide gets stuck in the well, a force is applied which is sufficient to shear pins 61 so that the upper section can be removed separately from the lower section.

Figure 6:
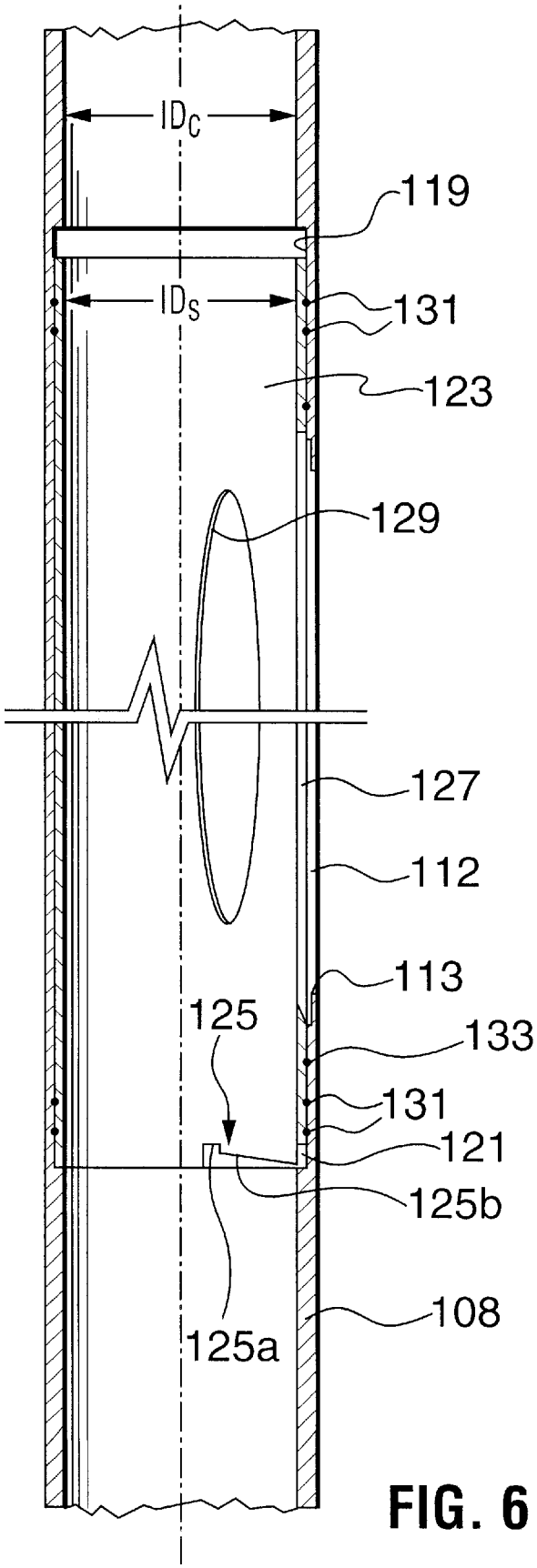
FIG. 6 is a longitudinal section along a casing section for a deviated wellbore junction according to the present invention.

Referring to FIG. 6, a casing section 108 according to the present invention is shown. Casing section 108 is useful in the drilling and completion of deviated well bores. It is used attached to other casing sections such as those indicated as sections 6 in FIG. 1 to form a casing string.

Figure 8:
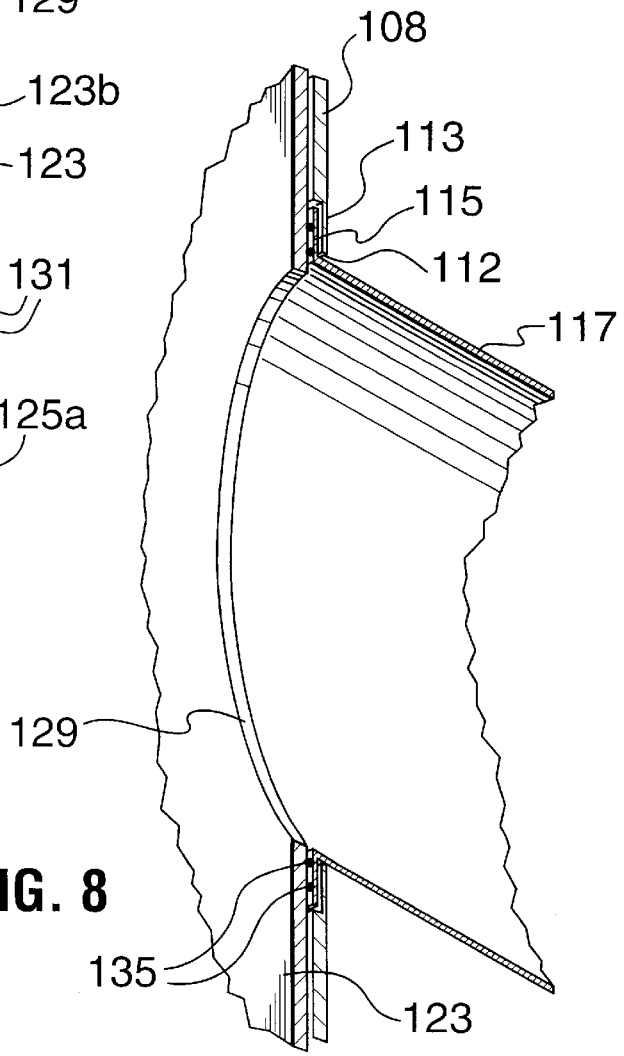
FIG. 8 is a sectional view through a deviated wellbore junction prepared using a casing section according to the present invention.

Casing section 108 includes a window opening 112 which is sized and shaped to permit directional drilling and insertion of deviated wellbore tools therethrough. Window opening 112 has a profiled edge 113. Edge 113 is formed to accommodate and retain a flange 115 (FIG. 8) formed on a deviated wellbore liner or tie back hanger 117.

Casing section 108 has a known internal diameter, indicated at IDc. A cylindrical section is removed from the inner surface of the casing to form a groove 119 which has a larger inner diameter than the casing. A key 121 is secured, as by welding, in the groove adjacent its bottom edge.

Figure 7:
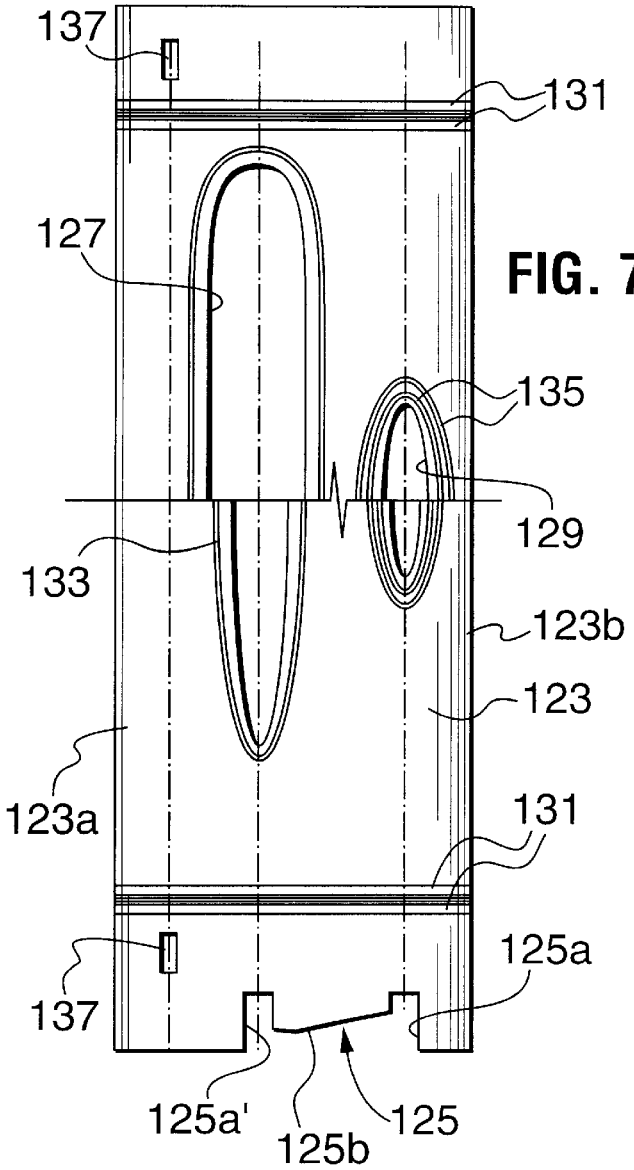
FIG. 7 is a rear elevational view of a sleeve according to the present invention in flattened configuration.

A sleeve 123 is disposed in groove 119. An embodiment of the sleeve is shown in flattened configuration in FIG. 7. To ready the sleeve shown in FIG. 7 for use, sides 123*a*, 123*b* of the sleeve are brought together and preferably attached, as by welding.

Sleeve 123 has a key slot 125 at its lower edge to engage key 121. Key slot 125 has two locking slots 125*a* and 125*a*$^1$ and a ramped portion 125*b* therebetween to facilitate movement of key 121 between slots 125*a*, 125*a*$^1$. Sleeve 123 is rotatable and longitudinally moveable in groove 119 and key slot 125 is formed to limit the movement of sleeve 123 over key 121 between a first position at locking slot 125*a* and a second position at locking slot 125*a*$^1$. Sleeve 123 is selected to have an inner diameter IDs which is greater than or equal to the inner diameter IDc of casing 108.

Sleeve 123 has a first opening 127 which is larger than window opening 112 but is positioned on the sleeve such that it can be aligned over window opening 112. Sleeve 123 preferably also has a second opening 129 which is substantially equal to or smaller than window opening 112. Second opening 129 is also positioned on sleeve 123 such that it can be aligned over window opening 112. Key slot 125 is shaped relative to key 121 to permit movement of the sleeve to align one of the first and second openings 127, 129 over window opening 112 and locking slots 125*a*, 125*a*$^1$ are positioned to lock the sleeve by its weight at these aligned positions.

Seals 131 are provided at the upper and lower limits of the sleeve between the sleeve and groove 119. Seals 133, 135 are also provided about openings 127 and 129, respectively. Seals 131, 133, 135 are each formed of materials which are hydraulically sealing such as o-rings positioned in retaining grooves. Preferably, the seating areas for the seals are treated, for example by machining to provide a smooth surface, to enhance the sealing properties of the seals. The seals act against the passage of fluids between the sleeve and the structure to which they are seated, for example the casing or the flange of a tie back hanger. In an alternate embodiment, the seals are secured to the casing and the sleeve rides over them.

An aperture 137 is provided on the sleeve which is sized to accept, and engage releasably latches on a shifting tool (not shown). The latches of the shifting tool hook into apertures 137 on sleeve 123 and shift tool is raised to pull the sleeve upwardly to release key 121 from locking slot 125*a* or 125*a*$^1$ into which the key is locked. The shifting tool then rotates sleeve 123 within groove 119.

In use casing section 108 having sleeve 123 disposed therein is prepared for placement downhole by aligning opening 127 over window 112. An aluminum liner is then inserted through the internal diameter and opening 112 is filled and wrapped, as discussed with respect to FIG. 2. A casing string is formed by attaching casing section 108 to other casing sections selected from those which have window openings or those which are standard casing sections. The casing string is then inserted into the wellbore and is aligned as desired. The wellbore is then completed.

After completion, the hardened cement and liners are removed from the casing string. This exposes sleeve 123 within casing section 108. A whipstock assembly, for example, according to the toolguide as described in reference to FIGS. 1 and 3 to 5C or any other whipstock assembly, is positioned in the well such that its upper sloping face is opposite opening 112 and a deviated wellbore is drilled.

Once the deviated wellbore is drilled, at least a junction fitting such as a tie back hanger 117 is run into the well and positioned such that its flange 115 is engaged on edge 113. Sleeve 123 is then lifted and rotated by engaging the setting tool in apertures 137 such that opening 129 is aligned over opening 112 and thereby the central opening of the tie back hanger. This causes seals 135 to seal against flange 115 and prevents fluids from outside the deviated casing from entering into casing section 108 at the junction. Using the sleeve of the present invention, the deviated wellbore does not need to be completed using cement to seal against passage of fluids outside the casing. However, where desired, the deviated wellbore can be completed using cement to increase the pressure rating of the seal.

Figure 9:
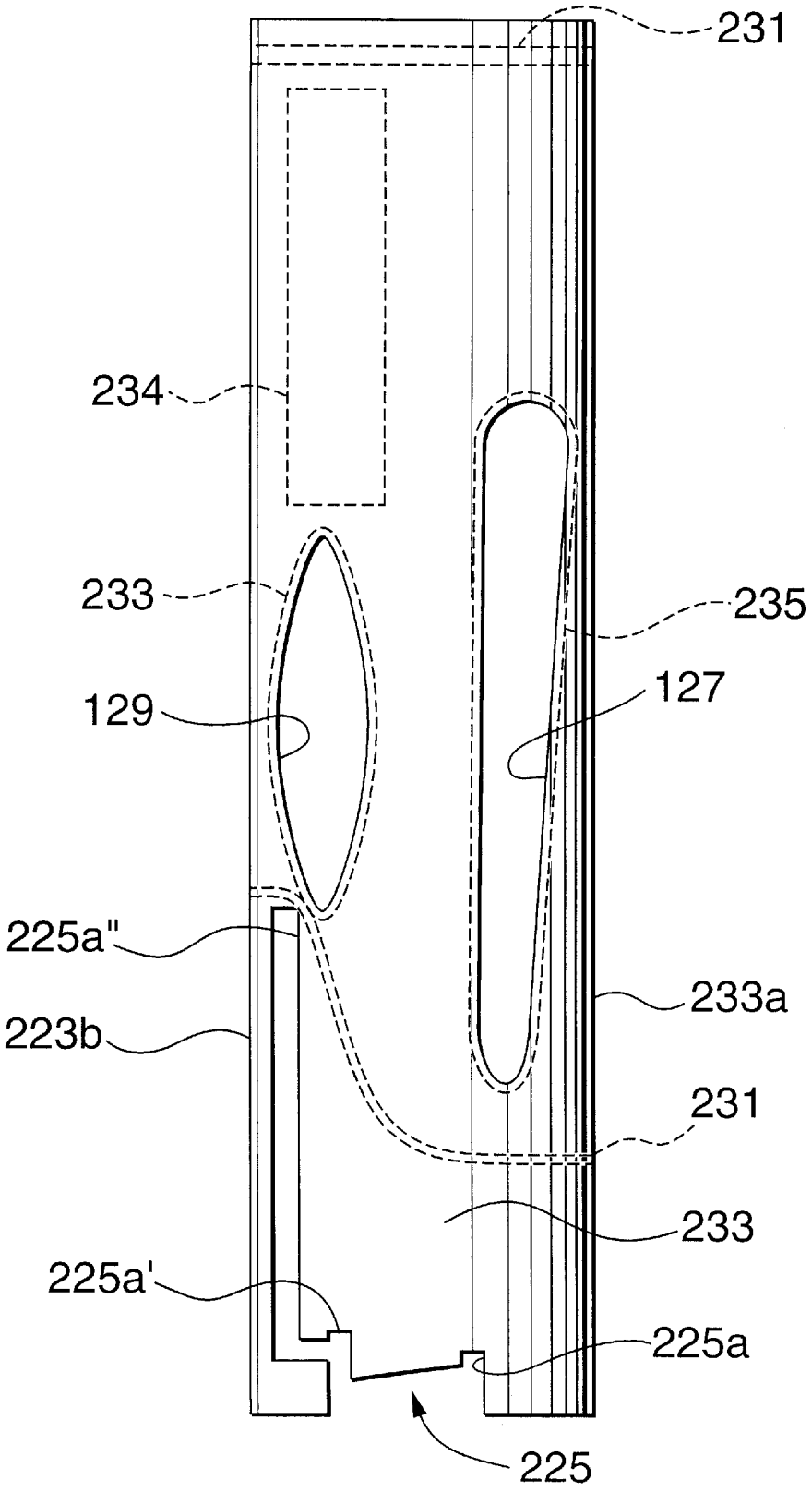
FIG. 9 is a front elevational view of another sleeve according to the present invention in flattened configuration.

The sleeve according to the present invention can be modified to permit other uses. For example, a sleeve can be used which has one or two openings which can be aligned with window opening and can also be positioned to block a window opening. Referring to FIG. 9, one embodiment of such a sleeve is shown. Sleeve 223 is shown in flattened configuration and when readied for insertion into a groove of a casing section sides 223*a*, 223*b* are brought together. A key slot 225 is formed at the lower edge of sleeve 223 for riding over a key formed in the groove of the casing section in which the sleeve is to be used. Key slot 225 has three locking slots 225*a*, 225*a*' and 225*a*" to permit sleeve 223 to be moved between three positions. The first position of which is where the key is locked, by the weight of the sleeve, into slot 225*a* and opening 127 is aligned with the window opening of the casing section. The second position is that in which the key is locked into slot 225*a*' and opening 129 is disposed over the casing window opening. The third position is the one in which the key is locked into slot 225*a*" and a solid portion of the sleeve indicated in phantom at 234, is disposed to block off the window opening of the casing section. The sleeve can be moved between any of these positions by a shifting tool. The groove into which the sleeve is mounted is formed to accommodate such movement.

Seals 233, 235 are provided around openings 127, 129 and seals 231 are provided around the upper and lower regions of sleeve 223 to hydraulically seal between the sleeve and the casing into which the sleeve is mounted. The seals are on the other side of the sleeve and are shown in phantom in this view.

It will be apparent that many other changes may be made to the illustrative embodiments, while falling within the scope of the invention and it is intended that all such changes be covered by the claims appended hereto.

The embodiments of the invention in which an exclusive property privilege is claimed are defined as follows:

1. A tool guide for creating deviated borehole branches from a wellbore comprising an upper section including a sloping face portion and a lower orienting section, including at least one latch biased radially outwardly from the orienting section and positioned in a known orientation relative to the sloping face portion, an outer housing and a latch locking means for releasably locking the latch in an extended position, the latch locking means actuatable to lock the latch by torsion of the upper section relative to the outer housing of the lower orienting section.

2. The toolguide of claim 1 wherein the lower orienting section is releasably connected to the upper section.

3. The toolguide of claim 1 wherein the lower orienting section further comprises a mandrel engaged slidably and rotatably within the housing, the mandrel being releasably connected to the upper section and moveable with the upper section, the latch locking means being an extension of the mandrel.

4. The toolguide of claim 3 wherein the toolguide further comprises an annular sealing means disposed below the upper section and actuatable by movement of the mandrel within the outer housing.

5. A toolguide for creating borehole branches from a wellbore, the toolguide having a longitudinal axis and comprising: an upper section including a sloping face portion; a lower orienting section; the upper section and the lower orienting section being connected and moveable relative to each other along the longitudinal axis of the tool and an annular sealing means mounted below the upper section, the annular sealing means being actuatable to expand and retract upon movement of the upper section and the lower orienting section relative to one another.

6. The toolguide of claim 5 wherein the lower orienting section comprises: an outer housing including a bore; and a mandrel engaged slidably and rotatably within the bore of the outer housing, the mandrel releasably secured to the upper section and moveable with the upper section and the annular sealing means being actuatable to expand and retract by movement of the mandrel within the outer housing.

7. The toolguide of claim 6 wherein the outer housing includes a first section and a second section and the annular sealing means is disposed therebetween, the first section being moveable toward the second section to compress the annular sealing means therebetween and actuate it to expand outwardly.

8. The toolguide of claim 7 wherein the mandrel includes a shoulder disposed thereon and positioned to abut against the first section of the outer housing to limit movement of the mandrel into the outer housing.

9. The toolguide of claim 3 further comprising a ratchet system disposed between the mandrel and the outer housing for frictionally locking the mandrel into a selected position within the outer housing.

10. The toolguide of claim 9 wherein the ratchet system includes a locking collet disposed on the mandrel and a knurled area on the outer housing adjacent the mandrel and positioned to be engagable by the locking mandrel.

11. The toolguide of claim 1 further comprising a ratchet system disposed between the mandrel and the outer housing for frictionally locking the mandrel into a selected position within the outer housing.

12. The toolguide of claim 11 wherein the ratchet system includes a locking collet disposed on the mandrel and a knurled area on the outer housing adjacent the mandrel and positioned to be engagable by the locking mandrel.

* * * * *